US006012698A

United States Patent [19]

Hardt et al.

[11] Patent Number: 6,012,698

[45] Date of Patent: Jan. 11, 2000

[54] METHOD AND APPARATUS FOR CLAMPING THE TRUNK OF A CHRISTMAS TREE

[75] Inventors: Rainer Hardt, Hilgert; Balthasar Schaaf, Hoehr-Grenzhausen; Johann Schaaf, Hilgert, all of Germany

[73] Assignee: Krinner GmbH, Strasskirchen, Germany

[21] Appl. No.: 09/091,060

[22] PCT Filed: Dec. 6, 1996

[86] PCT No.: PCT/EP96/05465

§ 371 Date: Jul. 6, 1998

§ 102(e) Date: Jul. 6, 1998

[87] PCT Pub. No.: WO97/20487

PCT Pub. Date: Jun. 12, 1997

[30] Foreign Application Priority Data

Dec. 6, 1995 [DE] Germany ..... 195 45 471

[51] Int. Cl.[7] ..... F16M 13/00

[52] U.S. Cl. ..... 248/523

[58] Field of Search ..... 248/523, 519, 248/511, 524

[56] References Cited

U.S. PATENT DOCUMENTS

| | | | |
|---|---|---|---|
| 2,242,270 | 5/1941 | Sims . | |
| 2,478,278 | 8/1949 | Kiesow . | |
| 3,301,512 | 1/1967 | Nyberg . | |
| 4,076,205 | 2/1978 | Almér et al. . | |
| 4,119,290 | 10/1978 | Gies | 248/523 |
| 4,326,703 | 4/1982 | Marley | 248/523 X |
| 5,160,110 | 11/1992 | Praegitzer | 248/523 |
| 5,464,186 | 11/1995 | Robert | 248/524 |
| 5,467,959 | 11/1995 | Behringer | 248/523 |
| 5,490,350 | 2/1996 | Eisenschenk et al. | 248/523 X |

FOREIGN PATENT DOCUMENTS

| | | |
|---|---|---|
| 1847128 | 12/1961 | Germany . |
| 29502365 | 6/1995 | Germany . |
| 2152807 | 8/1985 | United Kingdom . |
| WO89/03004 | 4/1989 | WIPO . |

*Primary Examiner*—Ramon O. Ramirez
*Attorney, Agent, or Firm*—Jordan and Hamburg LLP

[57] ABSTRACT

The invention relates to a method and an apparatus for clamping the trunk of a Christmas tree or the like, consisting of a stand, with at least three clamping jaws (5), which are disposed in a base plate (1) with an opening (2) for accommodating the trunk, are distributed about this opening (2) and can be moved into the accommodating opening (2) for clamping the trunk.

In order to be able to adapt the clamping jaws easily to the cross section of the trunk, to clamp the trunk securely with a small lift and to undo or eliminate the clamping easily, a fastener, which can be moved in two opposite directions and, in one direction moves the clamping jaws (5) out of the accommodating opening (2) and, in the other direction, initially releases the clamping jaws (5) so that they can move to lie against the trunk and subsequently presses the clamping jaws (5) with the required clamping force against the trunk, is assigned to the base plate (1).

17 Claims, 4 Drawing Sheets

METHOD AND APPARATUS FOR CLAMPING THE TRUNK OF A CHRISTMAS TREE

Figure 1:
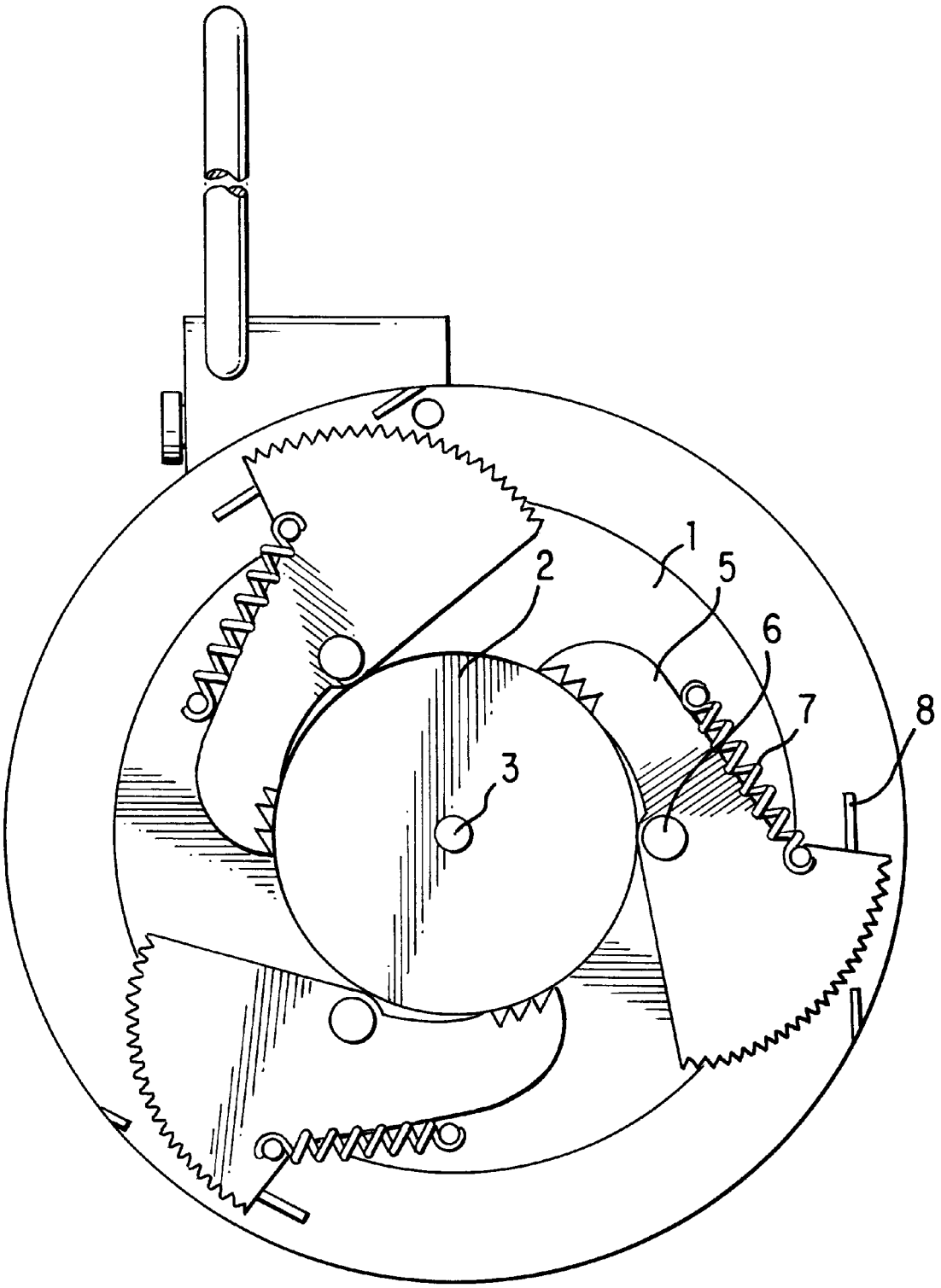

The invention relates to an apparatus for clamping the trunk of a Christmas tree or the like, consisting of a stand, with at least three clamping jaws, which are disposed in a base plate with an opening for accommodating the trunk and are distributed about this opening and can be moved into the accommodating opening for clamping the trunk.

For setting up Christmas trees, apparatuses are known, which are called stands and consist of a housing-like or frame-like supporting body, which has an accommodating opening, into which the lower region of the trunk of the Christmas tree can be inserted. Since the cross section of the trunks of Christmas trees differs and the Christmas trees must be aligned with their trunk in a vertical position, the opening of the supporting body is always larger than the maximum cross section of the trunk. Different apparatuses have become known for securing or clamping the trunk in this accommodating opening.

The German Offenlegungsschrift 36 06 778 discloses a Christmas tree stand, for which roll-shaped holding elements are pressed by a rotational movement against the trunk. It is not possible to fit this holding element individually to the shape of the trunk. Since the trunks of Christmas trees rarely are straight and uniformly round, the trunk can be aligned only by mechanical processing or connections. In order to be able to carry out the rotational movement, the Christmas tree stand must be fixed to the floor so that it does not rotate along. No safety mechanism is provided to prevent an automatic opening.

The German Auslegeschrift 28 14 830 discloses a stand, which is also suitable for accommodating Christmas trees. In the case of this stand, the holding force is applied exclusively by a strong spring. The opening is accomplished by way of a lever at the bottom of the sleeve accommodating the trunk. As a result, the simultaneous use of the sleeve as a water container is precluded.

In the German utility patent 94 18 483, a Christmas tree stand is described and shown, for which several holding elements are moved against the trunk by means of a rod with a denticulation and a lever with locking mechanism engaging thereon are moved against the trunk. In the case of trunks with relatively small cross sections, several lifting motions of the lever are required, until the clamping position is reached.

Finally, the German Offenlegungsschrift 39 32 473 discloses a Christmas tree stand, for which several holding elements are brought up to the trunk by shortening a rope loop. At the same time, the holding force becomes active only when all holding elements lie against the trunk. The rope is put under tension by a foot lever, so that, in every case, several lifts are required before all holding elements lie against the trunk. The rope, functioning as the actual clamping element, is fixed in its holding position by a latch mechanism. An additional lever is required for loosening the rope. The rope, serving as clamping element, cannot transfer any forces when the holding elements are opened. For this reason, for the reverse motion of the holding elements, special springs are provided, the force of which must be dimensioned so that they can pull out holding elements, which may have penetrated into the trunk, and can also overcome the friction of the rope.

It is therefore an object of the invention to indicate a method for clamping the trunk of a Christmas tree or the like, by which method it becomes possible to adapt the clamping jaws easily to the cross section of the trunk and to clamp the trunk securely and which does not require a large lift for the actual clamping motion. Moreover, it shall be an easy matter to loosen or cancel the clamping.

Pursuant to the invention, it is proposed for accomplishing this objective for a method of the type described above that the clamping jaws are moved by way of the fastener against the force of elastic elements out of the accommodating opening, that, after the trunk is inserted, the clamping jaws are released by a movement of the fastener and, at first, are brought into contact with the trunk by slightly tensioned elastic elements and that only subsequently the clamping jaws firmly clamp the trunk by means of a further movement of the fastener.

By means of such a method, the clamping jaws are brought into contact with the trunk for a clamping movement initially by the force of the elastic elements. Only then is the actual clamping motion initiated by way of the fastener. The lift required for this is relatively slight. The path of the fastener for loosening the clamping and, with that, for releasing the accommodating opening, is also relatively short. Even a trunk, clamped particularly firmly, can be loosened easily and reliably.

Further distinguishing features of an inventive method and apparatus are disclosed in the claims.

Figure 2:
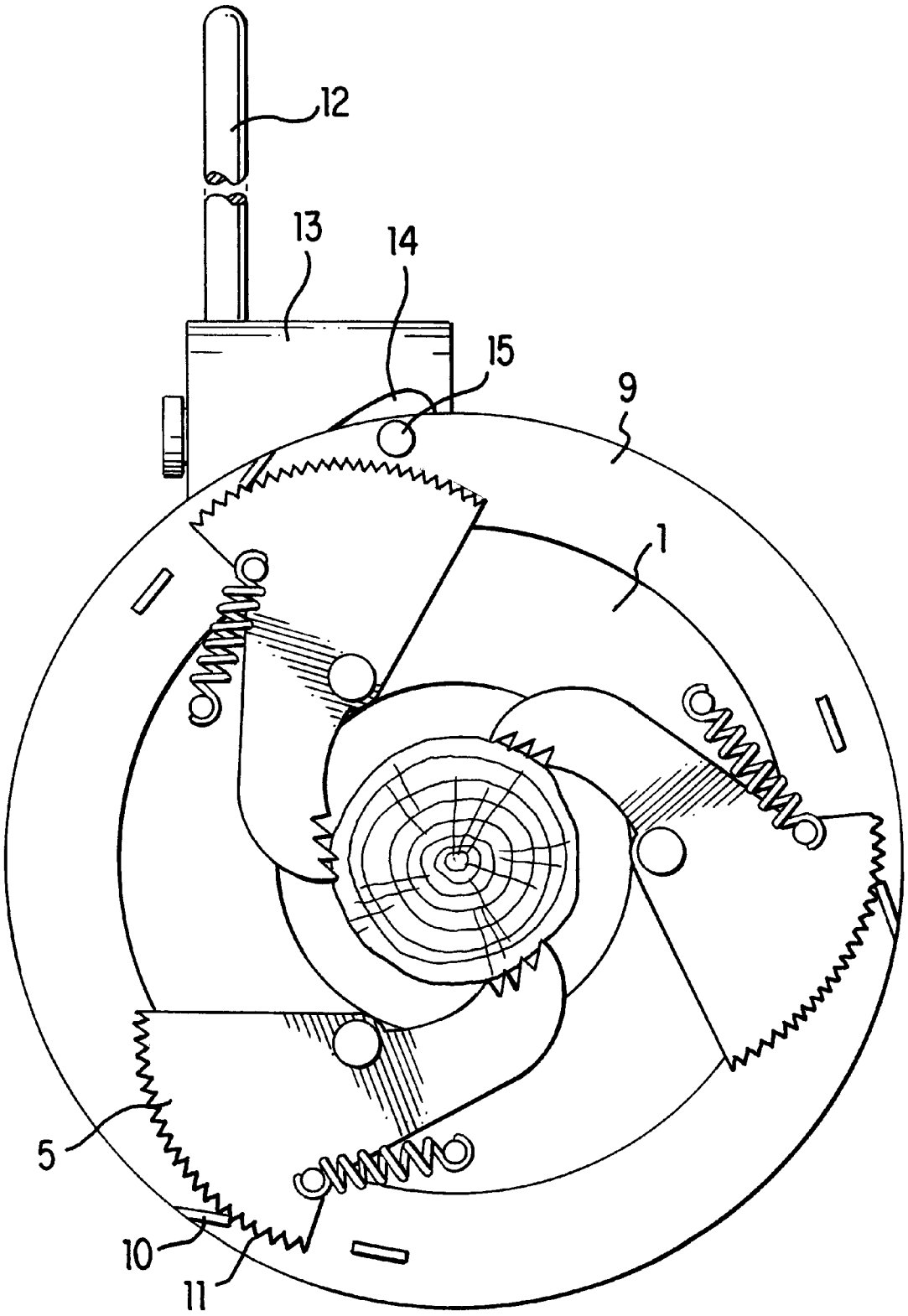
Figure 3:
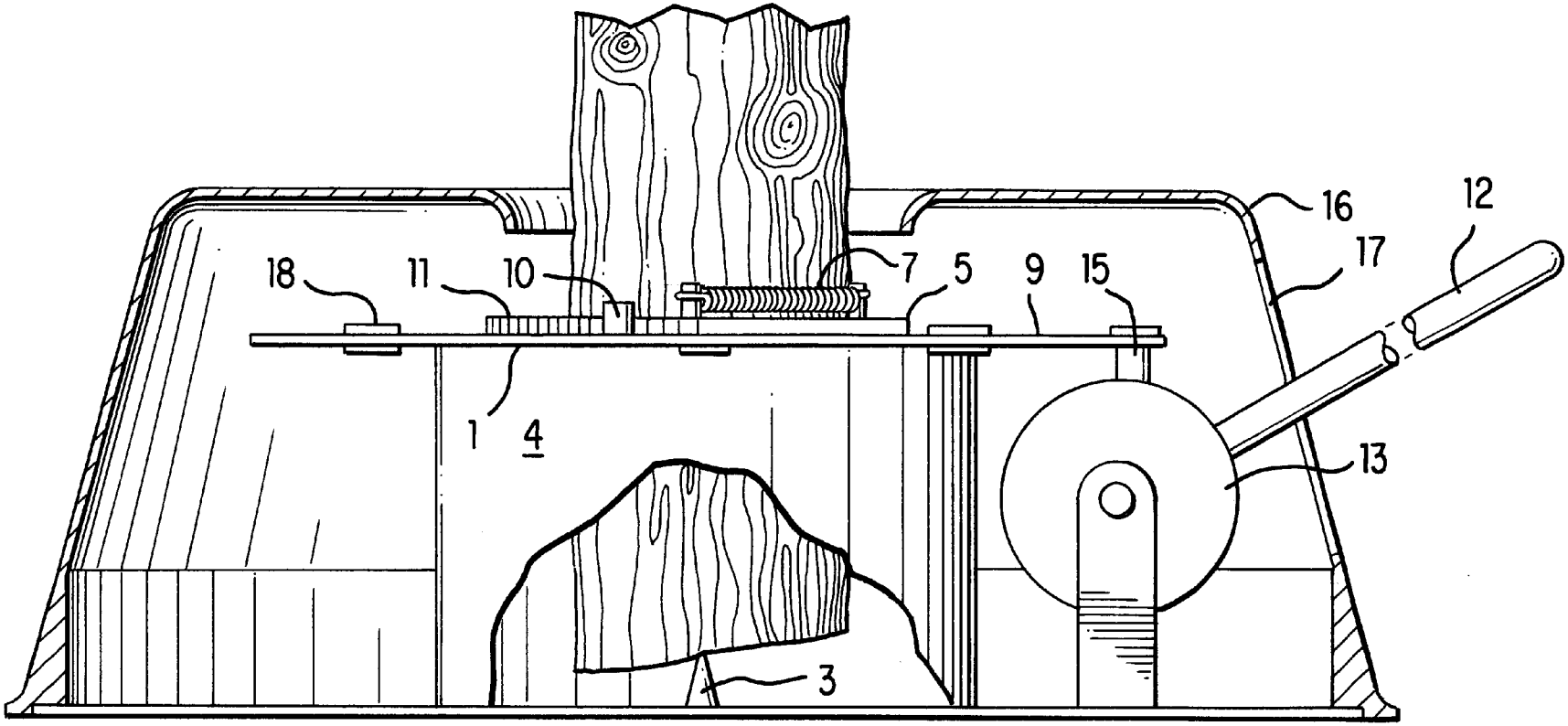
Figure 4:
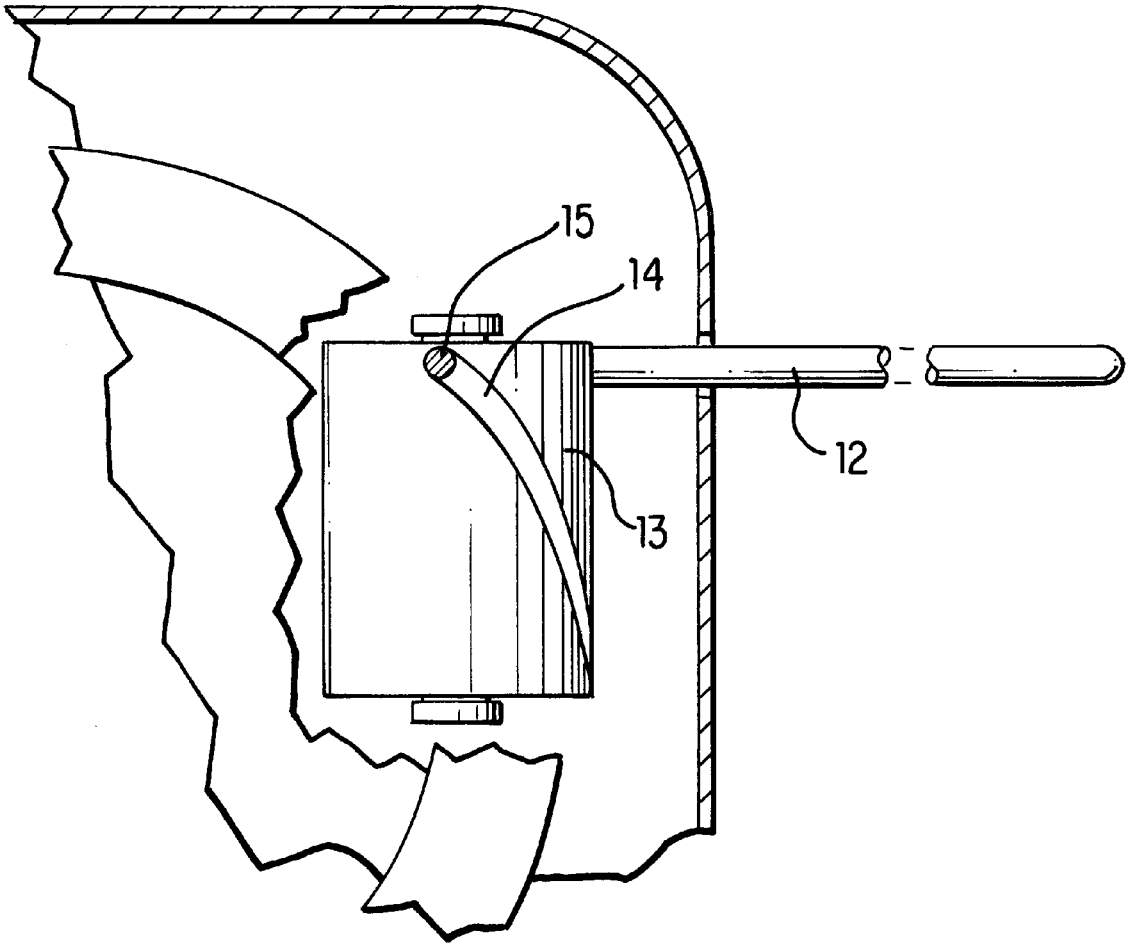

The invention is described in greater detail in the following by means of an example, which is shown in a simplified manner in the drawing, in which FIG. 1 shows a plan view of an inventive apparatus in the loosened position, FIG. 2 shows the apparatus of FIG. 1 in the clamped position, FIG. 3 shows the arrangement of the apparatus of FIGS. 1 and 2 in a stand and FIG. 4 shows a plan view of the configuration of an actuator.

In FIGS. 1 to 4 of the drawing, an apparatus for clamping the trunk of a Christmas tree, which is only indicated, is shown. To begin with, the apparatus consists of a base plate 1 with a circular outer contour. An accommodating opening 2, which also has a circular cross section, is incorporated in this base plate 1. The base plate 1 is disposed on a pot-like vessel 4 (FIG. 3), the bottom of which is provided with a centering point 3 and which can be used for accommodating water.

In the example shown, three bolts 6 are disposed on the base plate 1. They extend perpendicularly to the surface of the base plate 1 and each pivotably accommodates a clamping jaw 5. At each clamping jaw 5, one end of a spring 7 is connected, the other end of which is secured to the base plate 1. In the example shown, the springs 7 engage the clamping jaws 5 in such a manner, that the latter endeavor to turn counterclockwise on the bolts 6. This means that the clamping jaws 5 time and again attempt to assume a position as far as possible within the accommodating opening 2, as can be seen in FIG. 2.

At their ends protruding into the accommodating opening 2, the clamping jaws 5 are provided with a corrugation or denticulation which, over springs 7, can be brought to lie against the trunk, which is only indicated. At their other end, the clamping jaws 5 have a circularly extending denticulation 11.

A fastening ring 9, on which, in the example shown, there are a total of three dogs 8 and three catches 10, is assigned to the base plate 1. Of these, in each case one dog 8 and one catch 10 are assigned to a clamping jaw 5. The dogs 8 in each case serve for moving the clamping jaws 5 open, whereas the catches 10 are responsible for the movement, by means of which they are clamped fast By means of an appropriate rotational movement of the fastening ring 9, either the dogs 8 or the catches 10 come to lie or act against a clamping jaw 5. According to the representation of FIG. 1, the fastening ring 9 was turned in the clockwise direction, so that now a dog, which has moved the clamping jaws 5 into their open position, lies against all three clamping jaws 5. As soon as the trunk, which is indicated in FIGS. 2 and 3, was inserted into accommodating opening 2, the fastening ring 9 is rotated counterclockwise. With that, the dogs 8, which lie against the clamping jaws 5 in FIG. 1, are removed and the clamping jaws 5 can be swiveled by their springs 7 in such a manner, that they lie with their corrugation or denticulation against the trunk (FIG. 2), Upon further counterclockwise rotation of the fastening ring 9, the catches 10 engage the denticulation 11 of the clamping jaws 5, which leads to a clamping of the inserted trunk.

An actuator 12 to 15 is assigned to the fastening ring 9 for moving it. This actuator 12 to 15 consists first of all of a bolt 15, which is disposed at the underside of the fastening ring 9. This bolt 15 engages a spirally extending guiding slot 14 of a drum 13, which is mounted in a fixed position and can be turned by a lever 12. By appropriately swiveling the lever 12, the drum 13 and, with that, at the same time also the fastening ring 9 can be rotated in the appropriate direction, When the lever 12 is swiveled downward out of the position shown in FIG. 3, the drum 13, and with that the fastening ring 9 are turned in such a manner, that the clamping jaws 5 clamp the indicated trunk. However, if this lever 12 is raised, the clamping jaws 5 return to their initial position of FIG. 1. If necessary, the lever 12 can be inserted loosely into the drum 12, so that it can be removed as a safeguard against the unintentional loosening of the clamping. According to the representation in FIG. 3, the apparatus described, together with the vessel 4 and the actuator 12 to 15, is accommodated in a housing 16, which has a slot 17, through which the lever 12 passes to the outside.

In a modification of the example described, it is possible to swivel the clamping jaws 5 by friction. Moreover, the fastening ring 9 is formed from two rings which, between them, enclose the corresponding end of the clamping jaws 5. If necessary, the interacting engaging surfaces of the clamping jaws 5 and of the fastening ring 9 are provided with a coating to increase the friction. Moreover, it is possible to dispose the clamping jaws 5 so that they can be set radially on the base plate 1. The described actuator for moving the clamping jaws 5 can also be constructed in a different manner.

I claim:

1. An apparatus for clamping a trunk of a tree, comprising:

a stand including a base plate with an opening for accommodating the trunk;

at least three clamping jaws which are disposed on the base plate, the at least three clamping jaws being distributed about the accommodating opening and being movable to a position for clamping the trunk within the accommodating opening; and a fastener which can be moved in a first direction for moving the clamping jaws out of the accommodating opening and, in a second direction for pressing the clamping jaws against the trunk with a required clamping force, the fastener including dogs and catches for effecting movements of the clamping jaws, the dogs and the catches interacting with the clamping jaws only in specified positions, the clamping jaws each having a denticulation for a corresponding one of the catches, and the clamping jaws being biased in a direction inward of the accommodating opening and into contact with the trunk.

2. The apparatus of claim 1, wherein the clamping jaws are disposed on the base plate such that they are each pivotable about an axle.

3. The apparatus of claim 1, wherein the clamping jaws are disposed radially displaceably on the base plate.

4. The apparatus of claim 1, 2 or 3, wherein the elastic elements include one of a spring and a strip of elastic.

5. The apparatus of claim 1, 2 or 3, further comprising an actuator assigned to the fastener.

6. The apparatus of claim 1, 2 or 3, wherein the fastener includes a rotatable fastener ring.

7. An apparatus for clamping a trunk, comprising:

a stand including a base plate having an accommodating opening for reception of the trunk therethrough;

at least three clamping jaws mounted on the base plate and spaced apart peripherally about the accommodating opening, said at least three clamping jaws being movable from a first position permitting slidable reception of the trunk therebetween, to another position in which said at least three clamping jaws contact the trunk for clamping thereof within the accommodating opening, said at least three clamping jaws being biased inwardly of said accommodating opening; and a fastener movable in a first direction and in a second direction opposite said first direction, said fastener including dogs and catches for effecting movement of the clamping jaws between said first and second positions responsive to movement of said fastener in said first and second directions, respectively, the dogs and the catches interacting with the clamping jaws only in specified positions, the clamping jaws each including structure for engaging a corresponding one of the catches, movement of said fastener in said first direction effecting movement of the clamping jaws outward of the accommodating opening by engagement of said dogs with said clamping jaws and, movement of said fastener in said second direction operating to urge the clamping jaws against the trunk, continued movement thereof in said second direction urging said clamping jaws against the trunk with a desired clamping force.

8. The apparatus according to claim 7, wherein the clamping jaws are each pivotably mounted on the base plate.

9. The apparatus according to claim 7, wherein the clamping jaws are disposed radially displaceably on the base plate.

10. The apparatus according to claim 7, wherein said at least three clamping jaws are biased inwardly of said accommodating opening by one of a spring and a strip of elastic.

11. The apparatus according to claim 7, further comprising an actuator for rotating the fastener in response to force applied thereto.

12. The apparatus according to claim 7, wherein the fastener includes a rotatable fastener ring.

13. The apparatus according to claim 7, further comprising an open-top vessel for accommodating water, said base plate being disposed on said vessel.

14. A method for clamping a trunk of a tree into an accommodating opening of a stand by means of clamping jaws which can be moved in the accommodating opening by operation of a fastener in two opposite directions, the method comprising:

applying a biasing force to the clamping jaws for urging same in a direction inward of the accommodating opening;

moving the clamping jaws against the biasing force out of the accommodating opening by movement of the fastener in a first direction;

inserting the trunk in the accommodating opening;

releasing the clamping jaws by movement of the fastener in a second direction to bring the clamping jaws into contact with the trunk by operation of the biasing force; and firmly engaging the clamping jaws against the trunk by further movement of the fastener in said second direction, whereby the clamping jaws clamp the trunk therebetween.

15. The method of claim 14, wherein the movement of the fastener in said first direction and said second direction is transferred respectively by dogs and catches to the clamping jaws.

16. The method of claim 14, wherein the movement of the fastener in said first direction and said second direction is transferred to the clamping jaws by friction.

17. The method of claim 14, 15 or 16, wherein said step of applying a biasing force includes providing a pretensioned elastic element, the clamping jaws being brought into contact with the trunk in said step of releasing by operation of the pre-tensioned elastic element.

* * * * *